US005779812A

United States Patent [19]

Thies et al.

[11] Patent Number: 5,779,812

[45] Date of Patent: Jul. 14, 1998

[54] MULTI-MESH MECHANICAL FILTER SCREEN SYSTEM FOR DISHWASHERS

[75] Inventors: Edward L. Thies, Tipp City, Ohio; Roger J. Bertsch, Stevensville, Mich.

[73] Assignee: Whirlpool Corporation, Benton Harbor, Mich.

[21] Appl. No.: 694,221

[22] Filed: Aug. 8, 1996

Related U.S. Application Data

[60] Provisional application No. 60/003,255, Aug. 25, 1995.

[51] Int. Cl.[6] ..... B08B 3/02

[52] U.S. Cl. ..... 134/10; 134/111; 134/104.4

[58] Field of Search ..... 134/109, 111, 134/104.1, 104.4, 176, 179, 570, 56 D, 58 D, 10, 25.2; 210/305

[56] References Cited

U.S. PATENT DOCUMENTS

| | | | |
|---|---|---|---|
| 1,583,236 | 5/1926 | Murrish . | |
| 2,287,628 | 6/1942 | McMahan | 134/111 |
| 2,681,658 | 6/1954 | Meeker et al. | 134/111 |
| 2,862,510 | 12/1958 | Geiger et al. | 134/186 |
| 3,103,225 | 9/1963 | Matzen | 134/111 |
| 3,322,285 | 5/1967 | Lopp | 134/111 |
| 3,575,185 | 4/1971 | Barbulesco . | |
| 3,669,132 | 6/1972 | Mamrose . | |
| 3,989,054 | 11/1976 | Mercer . | |
| 4,038,103 | 7/1977 | Grunewald . | |
| 4,039,452 | 8/1977 | Fernandez . | |
| 4,150,679 | 4/1979 | Cushing et al. . | |
| 4,187,122 | 2/1980 | Query | 134/104.4 |
| 4,297,210 | 10/1981 | Delfosse . | |
| 4,319,599 | 3/1982 | Dingler et al. . | |
| 4,346,723 | 8/1982 | Geiger . | |
| 4,347,861 | 9/1982 | Clearman et al. . | |
| 4,392,891 | 7/1983 | Meyers . | |
| 4,559,959 | 12/1985 | Meyers . | |
| 4,673,441 | 6/1987 | Mayers . | |
| 4,969,479 | 11/1990 | Lagerstrand | 134/111 |
| 4,971,518 | 11/1990 | Florin . | |
| 4,972,861 | 11/1990 | Milocco et al. . | |
| 5,097,855 | 3/1992 | Martinsson et al. . | |
| 5,165,433 | 11/1992 | Meyers . | |
| 5,333,631 | 8/1994 | Kirkland et al. . | |
| 5,345,957 | 9/1994 | Cooper et al. . | |

FOREIGN PATENT DOCUMENTS

| | | | |
|---|---|---|---|
| 2432242 | 1/1976 | Germany | 134/111 |
| 3507229 | 9/1986 | Germany | 134/111 |
| 1352655 | 5/1974 | United Kingdom . | |

*Primary Examiner*—Frankie L. Stinson
*Attorney, Agent, or Firm*—Hill & Simpson

[57] ABSTRACT

A soil separator for a dishwasher includes soil accumulator channels open to the dishwasher chamber but covered by a filter screen having a fine filter region and a coarse filter region. Accumulator sumps are arranged below the accumulator channels. The shallow accumulator channels allow water to flush soil from an inside of the screen to the accumulator sumps. The channel below the fine filter region is flow connected through a pressure control valve or standpipe to the channel below the coarse filter region. If the fine filter region becomes clogged, the soil laden water can be passed into the coarse filter region for coarse screening.

15 Claims, 4 Drawing Sheets

MULTI-MESH MECHANICAL FILTER SCREEN SYSTEM FOR DISHWASHERS

This application claims the benefit of U.S. Provisional Application No. 60/003,255 filed Aug. 25, 1995.

SPECIFICATION

BACKGROUND OF THE INVENTION

The present invention is directed to a soil separator for a dishwasher and particularly a screen arrangement between a soil separator chamber and the dish compartment which provides an improved apparatus and method for collecting and filtering soil from dishwasher water.

A known arrangement for removing soil from dishwasher water is described in U.S. Pat. No. 5,165,433. This apparatus includes a combination motor-pump and soil separator assembly. The motor-pump assembly includes a wash impeller, which operates within a pump cavity located within the soil separator. As the impeller operates in a wash or rinse mode, a swirling motion is created in the wash liquid passing through the pump cavity, thereby creating a centrifugally sampled annular layer of wash liquid on the annular interior wall. A portion of the wash liquid having a high concentration of entrained soil (food particles, etc.) passes over an upper edge of the annular interior wall and into an annular guide chamber.

Wash liquid from this guide chamber travels to an annular soil collection chamber at a high flow rate. This high flow rate is achieved by use of a relatively small aperture located in a lower portion of the annular wall separating the guide chamber and the soil collection chamber. Upon entering the soil collection chamber, wash liquid flows outwardly and upwardly through a screen which separates the water from the soil. The wash liquid is prevented from draining out the soil collection chamber by a ball check valve seated within a drain port. The screen contains an annular arrangement of fine mesh filters, which prevent soil particles entrained in the wash liquid from reentering the dishwasher space. The cleansed wash liquid returns to the dishwasher floor where it is picked up by the motor driven pump for recirculation within the dishwasher.

Typically, the apparatus such as described above allows water to pass through the hole between the guide channel and the collector chamber at a rate of 4 to 5 gallons per minute. This flow rate can cause the heavily concentrated mixture of soil and water within the accumulator chamber to be agitated, preventing soils from readily settling. With this flow rate and configuration, there may be a tendency for the mechanical filter to clog even though back wash nozzles for spraying the filter from above are provided. For high flow rate soil collecting, filter screens with a 0.0049 inch mesh have had a tendency to clog. It was necessary to increase screen mesh to 0.0079 inch to prevent this clogging. However, the larger mesh screen allowed soils of larger particle size to escape through the screen and may be seen as "grit" on the dishes.

SUMMARY OF THE INVENTION

It is an object of the present invention to provide a dishwasher soil collection system which is compatible with a high flow rate soil removal dishwasher while at the same time allowing for adequate screening of soil in the dish water return to the dish compartment in a recirculating dish water system. It is an object of the invention to provide a more efficient method of soil collection and retention while reducing water and energy usage.

The objects are inventively achieved in that an annular soil separator wall is provided around a dish water pump chamber for accumulating solids by centrifugal action from the dishwater pump. A shallow soil accumulator channel or "screening channel", surrounding the separator wall and substantially annular, is arranged beneath an annular filter screen. The soil accumulator channel is flow connected to the pump chamber by a port through the soil separator wall at an inlet end of the accumulator channel. Water and soil proceed around the accumulator channel, soil is retained beneath the filter screen and water proceeds upwardly through the screen. The filter screen is divided into two sections, a coarse screen and a fine screen which account for a total of 360° of filter screen. The accumulator channel provides an annular floor with a first opening beneath the fine screen and a second opening beneath the coarse screen. The openings allow soil to fall into respective fine screened and coarse screened accumulator sumps therebelow each having a drain port closed by a check valve. Back wash nozzles are provided to wash the screen of soil from a dish compartment side of the filter screen. By utilizing inlet water in a circular flow path through the accumulator channel, the inside of the filter screen is washed while the outside of the screen is washed by the backwash nozzles from above. Therefore, food particles which are temporarily dislodged from the filter screen by the backwash nozzles may not immediately return after the backwash nozzle passes due to the flow inside of the screen from the soil separator water.

Inlet water flow into the shallow accumulator channel is kept in close proximity with the filter screen. As particles are dislodged by the backwash nozzles, they are moved around toward the openings which deliver the soil to the relatively stagnant soil accumulator sumps below. The sumps are located apart from and beneath the soil separator water inlet and therefore, more isolated and stagnant, allowing soil to settle.

The soil passing into the accumulator chamber is screened first by the fine screen. If the soil load is light, the screen may not clog. If it does not, water will be filtered by the fine mesh screen, cleaning the water of soil larger than the mesh size. Water is thus returned to the dish compartment for being recycled as wash water or rinse water. The soil progresses around the accumulator channel to pass through the first opening and into the fine filter screen accumulator sump. During a drain cycle, the ball check valve within this sump is opened and water and settled soil are pumped to drain.

A dividing wall separates the accumulator channel into a fine filter area and a coarse filter area. If the soil load is heavy, the fine screen may clog and water pressure will build beneath the fine screen in the accumulator channel.

A route is provided through the dividing wall to allow soil and water to escape the fine filter area and proceed into the coarse filter area, at a pressure below the level that forces the ball check valve in the fine screened accumulator sump to open which allows soil back into the circulating wash water system, typically 4½ PSI. The water escapes into the coarse filter area which is covered by the coarse screen. Soil in this area will be screened and water passed back into the dish compartment.

Thus, according to this invention, a filter screen is provided which automatically selects the minimum filter screen mesh to filter the dish wash water based on soil concentration and sizing. If soil load is heavy, the wash water will filter through the coarse screen until usually after the first drain cycle, then the wash water will begin to filter through the very fine mesh screen. If soil is light, the wash water will filter the entire cycle with a very fine mesh screen that could not ordinarily be used in dishwashers because the screen would clog too early in the wash cycle during a heavy soil load.

The present invention circumvents the compromise of using coarse screening because fine screening clogs too easily. An attempt is made to fine screen and only if the fine screen is clogged will the coarse screening be used.

DETAILED DESCRIPTION OF THE PREFERRED EMBODIMENTS

Figure 1:
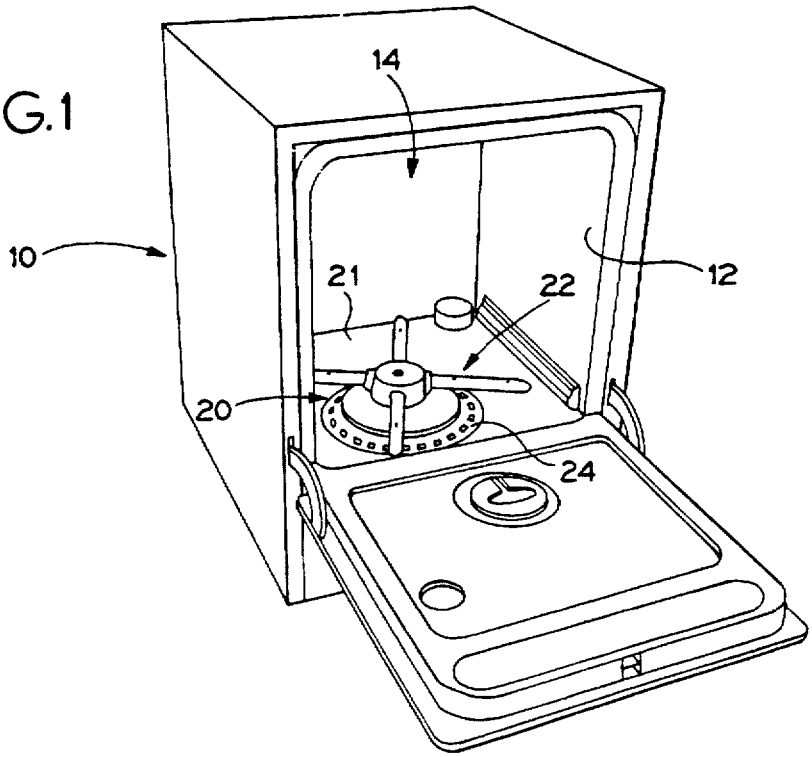
FIG. 1 is a perspective view of a dishwasher including a soil separator in accordance with the present invention.

In accordance with the invention as shown in the drawings, and particularly as shown in FIG. 1, an automatic dishwasher generally designated 10 includes an interior tank wall 12 defining a dishwashing space 14. A soil separator 20 is centrally located in floor 21 and has a lower wash arm assembly 22 extending form an upper portion thereof. Coarse particle grate 24 permits wash liquid to flow from floor 21 to soil separator 20, while preventing foreign objects, such as apricot pits and pop tops, from inadvertently entering soil separator 20.

The basic constructional features of the soil separator are explained in U.S. Pat. No. 5,165,433 herein incorporated by reference. Referring now to FIG. 3, the soil separator and pump assembly generally comprises a motor 27 having an output shaft 29 secured to base plate 30 by bolts 32. The motor 27 is a reversing motor which normally operates in a clockwise direction, as viewed in FIG. 2. When operated in a clockwise direction, such as in a wash mode or a rinse mode, the motor 27 provides a pumping action within soil separator 20, thereby providing pressurized wash liquid to lower wash arm assembly 22.

As shown in FIG. 3, lower wash arm assembly 22 includes a central hub 33 having a plurality of wash arms 35 extending radially therefrom. Each wash arm 35 includes one or more upwardly directed spray nozzles 38 for directing wash liquid upwardly within dishwashing space 14, and one downwardly directed spray nozzle 40 for providing a back-washing action, as will become apparent. Liquid passageway 42 in central hub 33 permits pressurized wash liquid to flow to the lower wash arm assembly 22.

Figure 2:
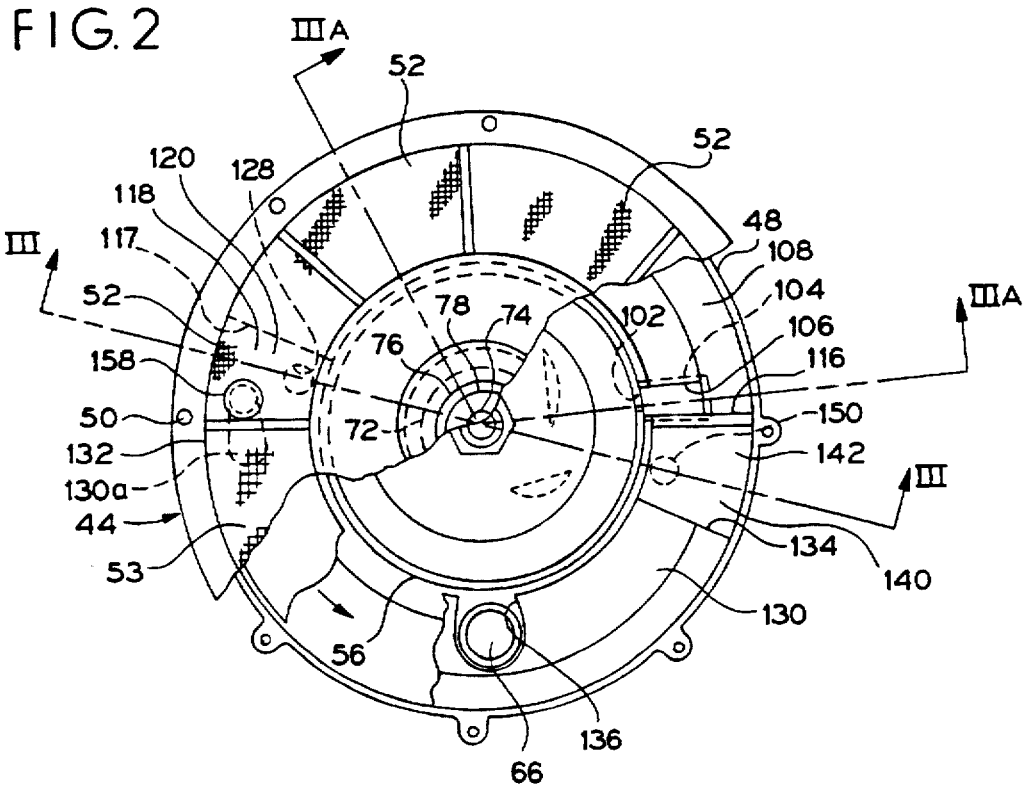
FIG. 2 is a plan view of the soil separator having the wash arm assembly removed therefrom and with a portion of the soil separator filter screen cut away.
Figure 3:
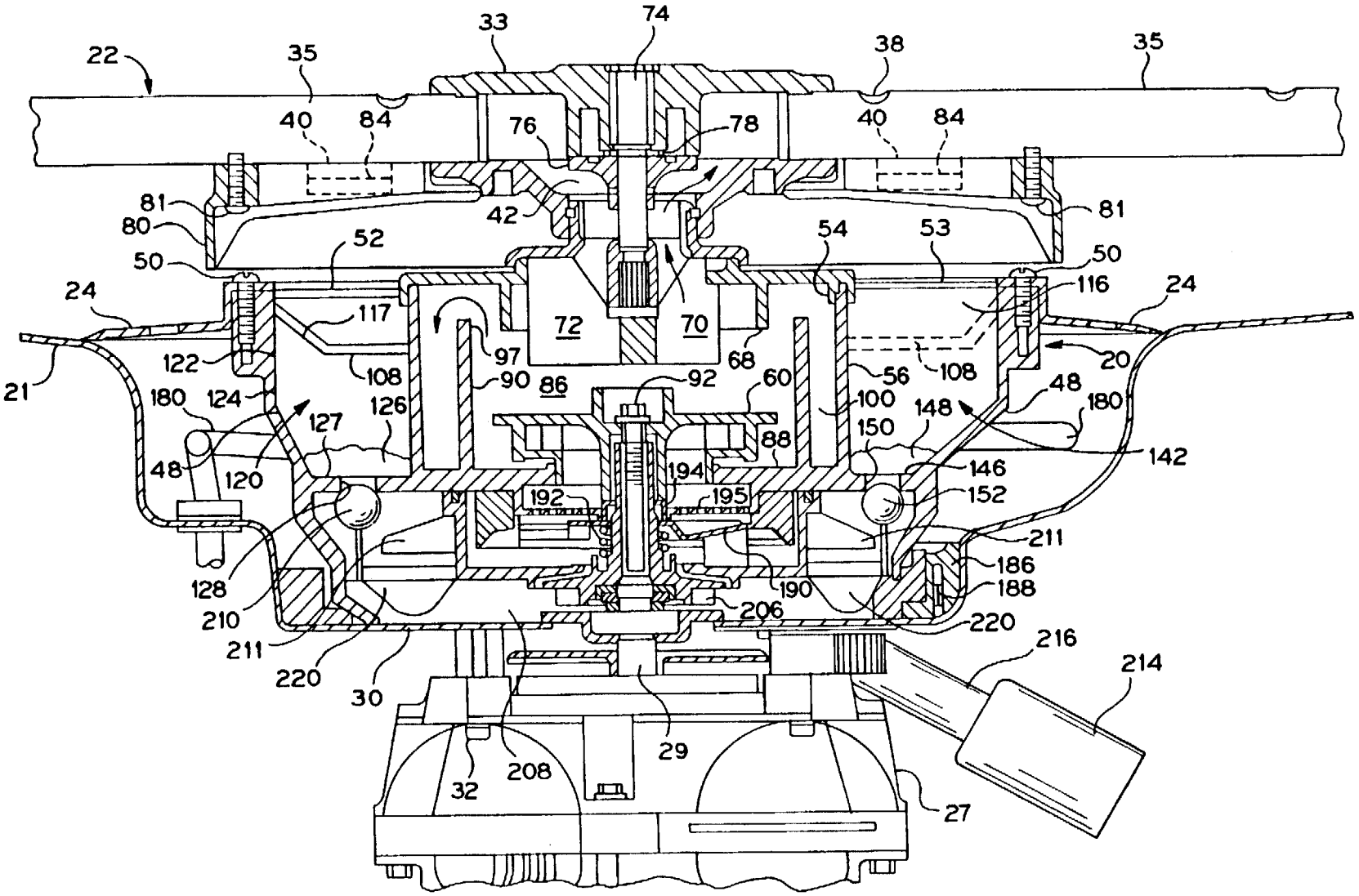
FIG. 3 is a diametric section of the soil separator including the wash arm assembly taken generally along line III—III of FIG. 2.
Figure 6:
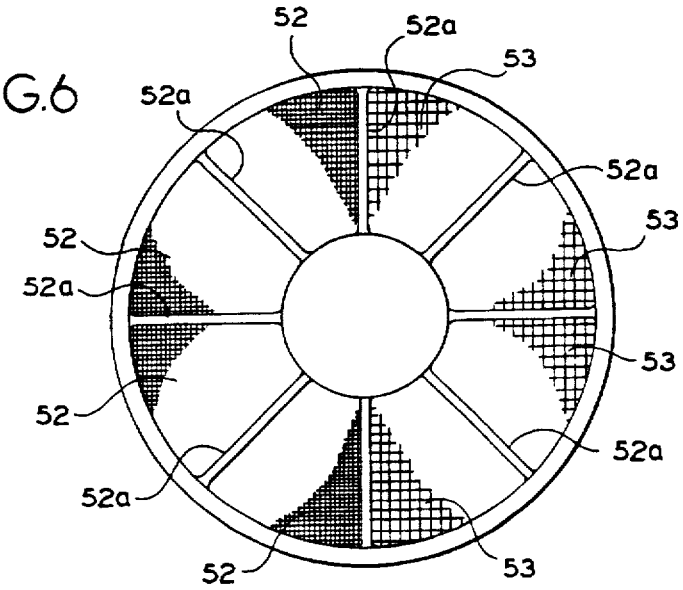
FIG. 6 is a plan view of the filter screen of FIG. 2.

As shown in FIG. 2, the soil separator 20 further includes an annular cover 44 which is disposed over and secured to soil container wall 48 by screws 50 or other means for attachment. When in place, cover 44 and soil container wall 48 combine to form a low-pressure water seal, preventing leakage of water therebetween. Cover 44 includes a series of fine mesh filter segments 52 which are radially disposed about a central axis of the cover and separated by ribs **52*a* (see FIG. 6). Fine mesh filter segments 52 are preferably formed of a synthetic material such as nylon or polyester and preferably have a mesh on the order of 0.0049". Depending on the material desired to be filtered, however, a larger or smaller mesh filter may be used. The cover 44 also includes a series of coarse mesh filter segments 53 which are radially disposed about the central axis of the cover and separated by the ribs 52*a*. The coarse mesh filter segments 53** are preferably also formed of a synthetic material and preferably have a mesh on the order of 0.0079" mesh.

Referring back to FIG. 3, located radially inwardly from the mesh filter segments 52, 53 and depending downwardly from cover 44 is an annular lip 54. Annular lip 54 forms a high-pressure seal in combination with an upstanding annular wall 56, as will become apparent. An upper wash arm feed channel (not shown) is disposed on top of cover 44, providing a continuous flow path for transporting pressurized wash liquid from the impeller 60, through upper wash arm feed tube (not shown), downwardly to a conduit 66 (shown in FIG. 2) and to the upper wash arm (not shown).

Further located radially inwardly from the annular lip 54 of the cover 44 is a downwardly depending annular wall 68. Annular wall 68 defines a centrally located interior area containing a plurality of vanes for directing pressurized wash liquid. Lower wash arm feed vanes 70 direct a first portion of the pressurized wash liquid through liquid passageway 42 to wash arms 35. Corresponding upper wash arm feed vanes 72 direct a second portion of the pressurized wash liquid to upper wash arm feed channel (not shown). Extending upwardly at the central axis of the cover is a fixed spindle 74.

Bushing 76 is mounted on spindle 74 by any appropriate conventional means, such as a drift pin. Washer 78 is supported by bushing 76, providing a low-friction support for lower wash arm assembly 22.

Referring to FIG. 3, it may be seen that lower wash arm assembly 22 is freely rotatably mounted about its central axis on spindle 74. A filter guard 80 is mounted to wash arms 35 by screws 81. Filter guard 80 overlies the fine mesh filter segments 52 and 53 of cover 44, protecting fine mesh filter segments 52 and 53 from damage caused by falling utensils or tableware. In operation, pressurized wash liquid flows past bushing 76 into wash arms 35. Upwardly directed nozzles 38 are positioned on wash arms 35 so as to provide a chordally directed thrust, causing lower wash arm assembly 22 to rotate about spindle 74 when pressurized wash liquid is pumped through nozzles 38.

As lower wash arm assembly 22 rotates, pressurized wash liquid is emitted from downwardly directed nozzles 40. A deflector tab 84 integrally formed as part of filter guard 80 is disposed directly beneath each nozzle 40, impinging on the flow of wash liquid emitted therefrom. As the flow of water from each nozzle 40 strikes the associated deflector tab 84, a fan-shaped spray is formed. Each fan-shaped spray sweeps the top of the mesh filter segments 52, 53 as lower wash arm assembly 22 rotates, thereby providing a back-washing action to keep mesh filter segments 52, 53 clear of soil particles which may impede the flow of cleansed wash liquid into dishwashing space 14.

The wash impeller 60 is located within pump cavity 86. Pump cavity 86 is generally defined by the soil separator lower housing wall 88, the upstanding wall 56, and the cover 44.

Wash impeller 60 is secured to the output shaft 29 of pump motor 27 by impeller retaining bolt 92, and pumps wash liquid when in operation. The majority of the pressurized wash liquid enters the area beneath the cover 44 defined by downwardly depending annular wall 68, and is divided and directed by lower wash arm feed vanes 70 and upper wash feed vanes 72. Under normal operating conditions, flow of pressurized wash liquid is provided to the lower wash arm and to the upper wash arm.

During normal operation, a third portion of the wash liquid is maintained within the soil separator to be cleansed and returned to circulation. In pump cavity 86, a portion of the wash liquid having a high concentration of entrained soil tends to accumulate on the inside upstanding annular wall 90. The swirling motion of the liquid tends to carry the soil upwardly over the upper edge 97 of wall 90, whereupon the soil-laden liquid collects within annular guide chamber 100 defined between the inside upstanding annular wall 90 and outside upstanding annular wall 56. Undesirable pressure loss within the annular guide chamber 100 is prevented by forming a relatively water-tight, high pressure seal at the juncture of cover 44 and outside upstanding annular wall 56.

Figure 3A:
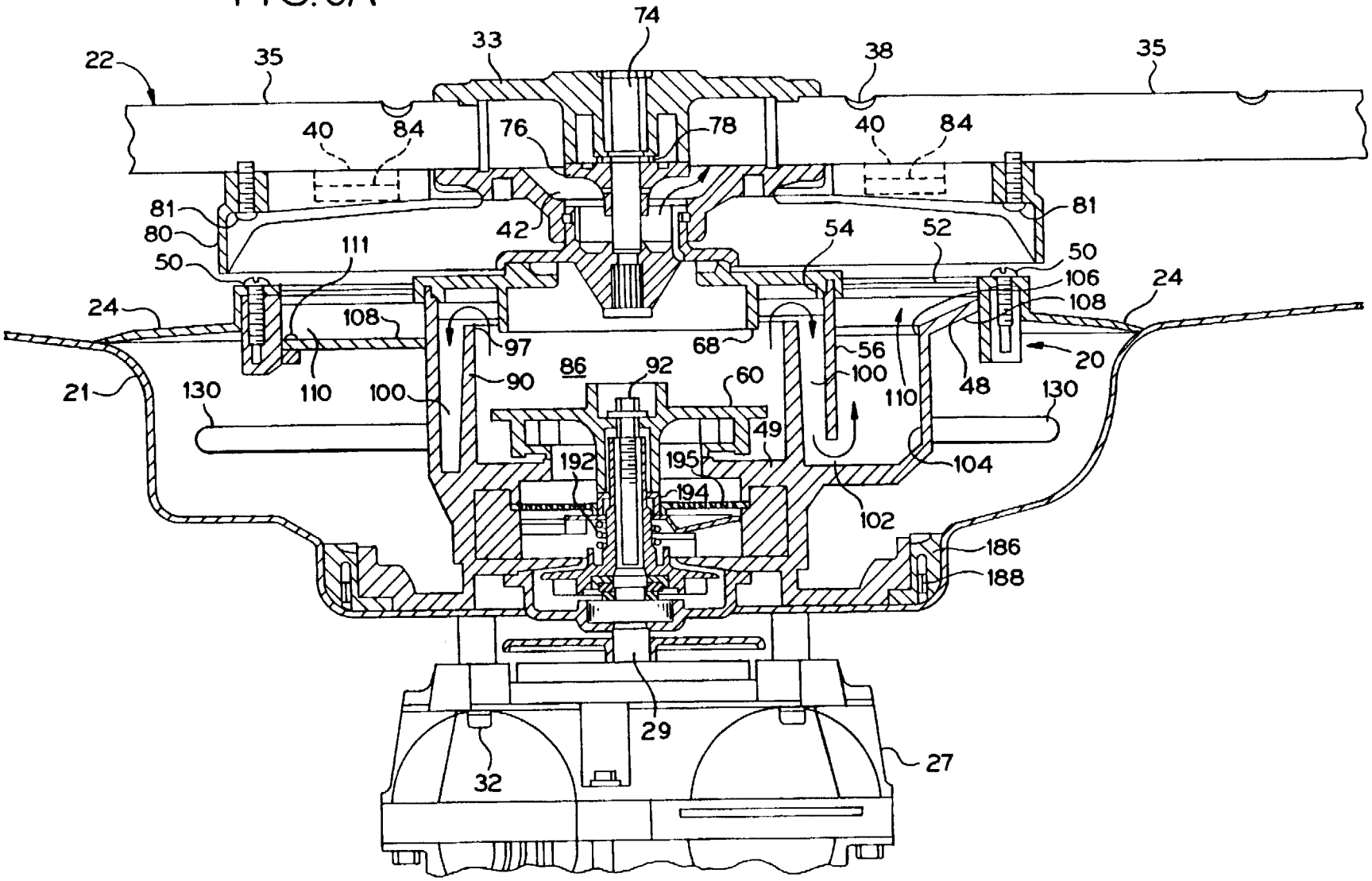
FIG. 3A is sectional view of the soil separator taken generally along line IIIA—IIIA of FIG. 2.

As shown in FIG. 3A, soil laden water flows through an inlet 102 into a tube 104 and upward through a hole 106 formed through a substantially annular plate 108. The plate 108 forms a shallow soil accumulator channel 110 beneath the screen segments 52.

Figure 4:
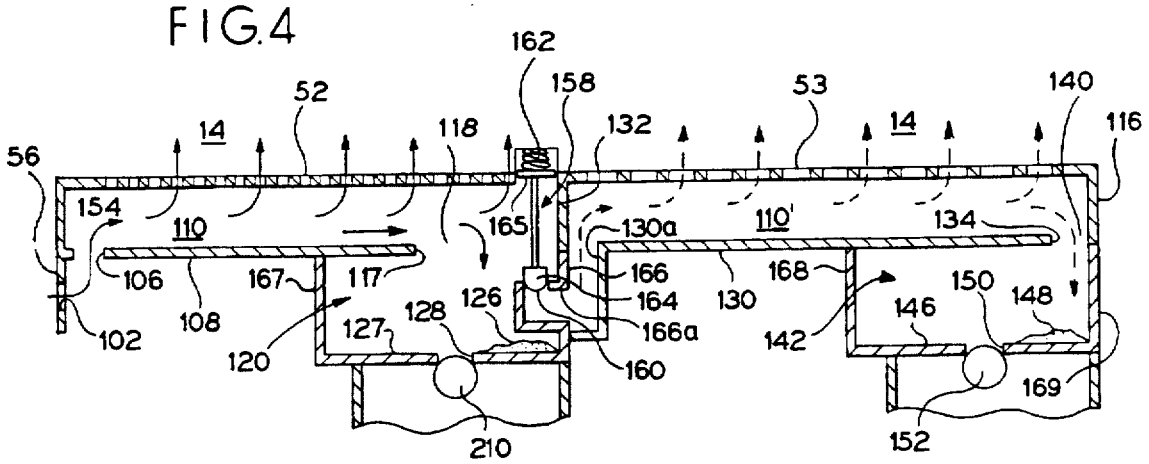
FIG. 4 is a schematic sectional view of a screening channel from FIG. 3, taken around the circumference.
Figure 5:
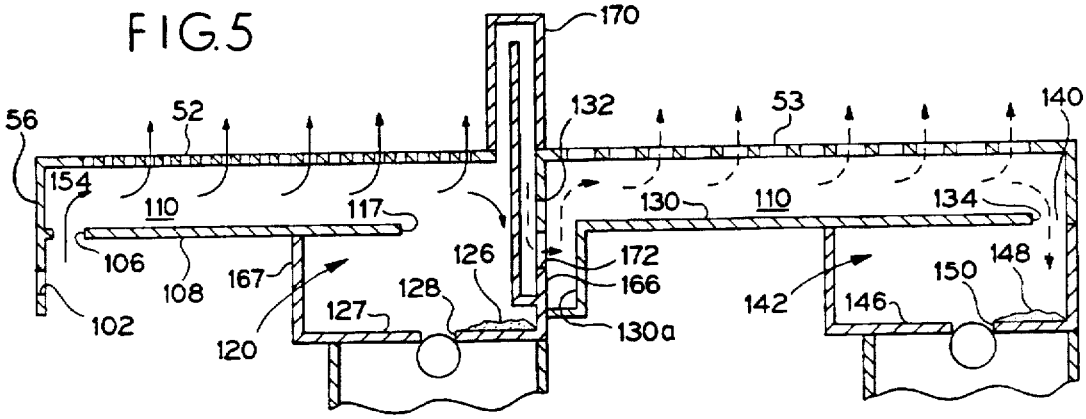
FIG. 5 is a schematic sectional view of an alternate screening channel.

As shown in FIGS. 2, 4 and 5, the plate 108 has an end plate 116 extending upwardly therefrom to the screen segments 52. In operation, the soil laden water proceeds through the hole 102 above the plate 108 and proceeds in a counterclockwise direction in FIG. 2. Water passes upwardly through the screen 52 as the soil proceeds along the annular plate 108 to its terminal end 117. The terminal end 117 partially defines an opening 118 through which soil can settle downwardly into a fine filtered soil sump 120.

By maintaining a shallow accumulator channel 110 between the plate 108 and the screen segments 52, from the opening 102 to the sump 120, any clogging of the screen segments 52 on an inside thereof can be effectively reduced. When the backwash nozzle 40 passes, soil is back washed away from the screen, and water passing within the channel 110 moves the soil around the semiannular plate 108, and into the sump 120 and prevents repositioning of the soil against the screen segments 52.

Fine mesh filter segments 52 in cover 44 permit flow of cleansed wash liquid to return to dishwasher space 14 for recirculation. Light soil particles are screened by fine mesh filter segments 52 and deposited in soil accumulator sump 120. Accordingly, both heavy and light soil particles remain within the soil accumulator sump 120.

FIG. 3 illustrates that the sump 120 is defined by walls 56, 48, a floor 127, and side walls 122, 124. Soil 126 is collected within the sump 120 on the floor 127 and expelled during the drain cycle through the drain port 128.

As illustrated in FIG. 2 a second substantially semiannular plate 130 is installed horizontally partially surrounding the upstanding wall 56 at substantially the same elevation as the first semiannular plate 108. The second semiannular plate 130 has dividing wall 132 extending vertically between the plate 130 and one of the coarse screening elements 53. The dividing wall 132 is located adjacent the sump 120. The second semiannular plate 130 extends to a terminal end 134. The second plate 130 is also cupped like the first plate 108 to form a shallow screening channel identical to the channel 110, except below the coarse screen elements 53. Additionally a cut out 136 is provided to accommodate the conduit 66. The second plate 130 is otherwise very similar in size and shape to the first plate 108.

The second terminal end 134 partially defines an opening 140 for allowing soil to settle into a coarse soil filter sump 142. The sump 142 is adjacent the end wall 116.

As shown in FIG. 3, the coarse filter sump 142 is defined between the upstanding wall 56, outer wall 48 and a bottom wall 146. Soil 148 collects on the wall 146 to be drained through the port 150 during a drain cycle. A check valve 152 closes the port 150.

As shown in FIG. 4, soil laden water 154 enters the opening 106 through the plate 108 from the opening 102 through the accumulator wall 56. The soil 126 is screened by the fine screen elements 52 and the water returns to the dishwater compartment 14. The soil 126 moves across the plate 108 and settles into the fine filtered soil sump 120. A diaphragm pressure valve 158 is provided to close a port 160 through the dividing wall 132. A spring 162 biases a plug 164 to close the port 160. The spring 162 acts on a diaphragm 165 which is subject to pressure within the fine screening chamber 110. If the fine screen elements 52 become clogged, pressure will rise in the chamber 110 until the plug 164 is raised to open the port 160 to pass water and soil 154 through an opening **166*a* through a radial wall 166 and upward through a conduit 130*a* into a second screening chamber 110 above the plate 130 and beneath the coarse screen elements 53. The soil laden water is screened by the screen elements 53 and water returns to the compartment 14. The soil passes over the plate 130 to settle into the coarse filter soil sump 142**.

Below the plate 108 the sump 120 is further defined by radial walls 166, 167. Below the plate 130 the sump 142 is further defined by radial walls 168, 169.

FIG. 5 describes an alternate arrangement wherein the valve 158 is replaced by a standpipe 170 flow connected to an opening 172 through the dividing wall 166. The opening 172 is flow connected into the conduit **130*a* to pass water into the channel 110. The standpipe provides sufficient flow resistance to force water to flow through the fine filter elements 52 before reaching the coarse filter elements 53. To eliminate siphoning, a siphon break may be required on the top of standpipe 170**.

When operated in a wash or rinse mode, the dishwasher functions as a continuous fluid circuit. In a wash mode, for example, wash liquid flows from dishwashing space 14 to dishwasher floor 21 and is gravity-fed to coarse particle grate 24. Wash liquid flows past heating unit 180 to soil separator 20, where it is drawn inwardly by negative pressure created by impeller 60. Wash liquid flows over sealing ring 186, which, in combination with floor 21 and retainer ring 188, serve to support and seal the soil separator and pump assembly within the dishwasher. Wash liquid continues to flow horizontally and inwardly over base plate 30, until encountering soft soil chopper 190.

As may best be observed in FIG. 3, soft soil chopper 190 is located on motor shaft 29 and rotates therewith to macerate large soft soil particles which travel past grate 24. Torsion spring 192 both supports and drives chopper 190, urging chopper 190 upwardly against collar 194, which in turn is held in place on output shaft 29 by a downwardly depending shoulder of wash impeller 60.

After passing soft soil chopper 190, wash liquid is drawn through grate 195 and further upwardly into pump cavity 86 by wash impeller 60. Wash impeller 60 imparts a swirling motion to the wash liquid, forcing a majority of the wash liquid upwardly to lower wash arm feed vanes 70 and upper wash arm feed vanes 72. Wash liquid sprayed from upwardly directed spray nozzles 38, downwardly directed spray nozzles 40 and cleansed wash liquid emitted from fine mesh filter segments 52 into dishwashing space 14 returns to floor 21 to be recycled.

Due to centrifugal force acting on the swirling liquid in pump cavity 86, the remainder of the wash liquid forms a band or layer on the interior of upstanding annular wall 90. This band of wash liquid contains a heavy concentration of entrained soil particles having a relatively high specific gravity, which tend to be forced outwardly by centrifugal force. This band of wash liquid also contains approximately the same concentration of soil particles having a relatively low specific gravity representative as the wash liquid as a whole. A portion of this soil-laden water passes through opening 102 into soil accumulator channel 110.

As soil-laden wash liquid flows around soil accumulator channel 110, its velocity is reduced, permitting heavy soil particles to collect in sump 120 on lower housing wall 127. As the clockwise rotation of wash impeller 60 forces soil-laden wash liquid into soil accumulator channel 110, clockwise rotation of drain impeller 206, as shown in FIG. 3, causes a clockwise flow of wash liquid within drain pump chamber 208.

Pressure created by wash liquid flow within drain pump chamber 208 causes ball check valve 210 and 152 to rise from a resting position on ball check valve supports 211 to a seated position on the bottom side of soil container drain port 128 and 150, as shown in FIG. 3. When so positioned, ball check valve 210 and 152 prevents flow of accumulated soil particles and wash liquid therethrough. A third check valve 214 located in line with and downstream of a drain port (not shown) and prevents air from entering the drain port during operation of drain impeller 206 in a clockwise direction.

Upon completion of a wash or a rinse cycle, a drain cycle is initiated. At that time, pump motor 27 is reversed, causing drain impeller 206 to rotate in a counter-clockwise direction, as viewed in FIG. 2. Drain impeller 206 causes negative pressure to be applied within conduit 220, which causes ball check valve 210 to fall away from soil container drain port 128, and ball check valve 152 to fall away from the drain port 150. Soil-laden water and accumulated soil within soil accumulator sumps 120, 142 is rapidly pumped out by drain impeller 206, and expelled through a drain port 216 connected to the conduit 220. In addition, drain impeller 206 is further in fluid connection with floor 21. Wash or rinse liquid draining from soil separator 20 accumulates on base plate 30, and is pumped out through the drain port 216 along with liquid from floor 21. Accordingly, when operated in a counterclockwise direction, drain impeller 206 rapidly and effectively drains soil separator 20.

Although the present invention discloses two screening areas, a fine mesh and a coarse mesh, three or more screening areas of varying mesh size could be provided and is encompassed by the present invention. Also, rather than two plates 108, 130 having openings 118, 140 open to two sumps 120, 142, a continuous annular plate can be provided with slots to allow soil to pass downward into a soil collection sump assuming the 2 screen areas above and below the slotted plate are isolated from each other. The fine screening channel can be connected to a coarse screening channel by a pressure actuated valve arrangement such as in the present invention.

Additionally, whereas the above described embodiment discloses a concentration wall and the spillover such as disclosed in U.S. Pat. No. 5,165,433 using a vertical tube to channel flow from the opening 102 to the top side of the plate 108, a direct horizontal flow between the pump chamber 86 and the channel 110 can be used. However, this method minimizes the effect of centrifugal soil separation and becomes a sampling system somewhat less effective than the centrifugal soil separation system.

Although the present invention has been described with reference to a specific embodiment, those of skill in the art will recognize that changes may be made thereto without departing from the scope and spirit of the invention as set forth in the appended claims.

We claim as our invention:

1. A soil separator for a dishwasher comprising:

a cylindrical wall;

a water impeller arranged for rotation within said cylindrical wall;

a shallow arcuate channel flow connected to an area within the cylindrical wall;

a first screen covering a first portion of said arcuate channel and having a first mesh size;

a second screen covering a second portion of said arcuate channel and having a second mesh size different than said first mesh size;

wherein said channel comprises a dividing wall separating said channel into a fine filtering channel covered by said first screen and a coarse filtering channel covered by said second screen; and a conduit with a flow restriction arranged between said fine filtering channel and said coarse filtering channel.

2. The soil separator according to claim 1, wherein said conduit and said flow restriction comprises an opening through said dividing wall with a pressure control valve covering said opening.

3. The soil separator according to claim 1, wherein said restriction is adapted to open when water pressure within said fine filtering channel is above a predetermined pressure to pass water to said coarse filtering channel.

4. The soil separator according to claim 3, further comprising a soil accumulation sump arranged below said arcuate channel and flow connected to one of said fine and coarse filtering channels.

5. The soil separator according to claim 3, further comprising two soil accumulation sumps, each arranged below and flow connected to, said fine and coarse filtering channels respectively.

6. The soil separator according to claim 5, wherein each sump comprises a drain port closed by a ball check valve.

7. A dishwasher soil separator, comprising:

a rotating wash impeller;

a circular surrounding wall;

an outlet water conduit receiving water flow from said rotating impeller;

a soil laden water flow channel receiving soil laden water flow from adjacent said surrounding wall;

an annular soil screening channel having an annular plate with a soil laden water inlet region having an end wall and having two screen elements on a top side thereof of different mesh sizes, for passing water therethrough while retaining soil below said elements, said screening channel surrounding said surrounding wall, said soil laden water flow channel flow connected to said inlet region of said screening channel;

a soil accumulator sump arranged below said annular plate and flow connected to said screening channel at two locations around said annular screening channel; and a means for draining soil from said accumulator sump.

8. The dishwater soil separator according to claim 7, wherein said screening channel is divided by a wall located between said two screen elements and said two locations are on opposite sides of said wall below said two screen elements respectively; and further comprising a flow control means for passing water across said wall.

9. The dishwater soil separator according to claim 8, wherein said soil accumulator sump comprises two separate sump compartments, each having a bottom port closed by a check valve.

10. A method of screening soil laden water in a water recirculating dishwasher having a dish compartment for holding dishes to be cleaned, and fine and coarse screens, comprising the steps of:

recirculating soil laden wash water from said dish compartment;

fine screening said soil laden wash water with the fine screen;

if the fine screen becomes sufficiently clogged to create a first predetermined back pressure, diverting said soil laden wash water to the coarse screen by passing said soil laden wash water through a flow restricted conduit;

returning a water component of said soil laden wash water to said dish compartment; and collecting said soil separated from said soil laden wash water in a location for eventual disposal.

11. The method according to claim 10, wherein said step of fine screening said soil comprises:

passing said soil laden wash water into a fine screening channel having an inlet at one end thereof and a fine mesh screen covering a top thereof, otherwise open to the dish compartment.

12. The method according to claim 10, wherein said step of diverting said soil laden wash water comprises the steps of:

providing a coarse screening channel having an inlet from said fine screening channel and having a coarse mesh screen covering a top thereof, otherwise open to the dish compartment.

13. The method according to claim 10, wherein said step of fine screening said soil comprises passing said soil laden wash water into a fine screening channel having an inlet at one end and a fine mesh screen covering a top thereof, otherwise open to the dish compartment;

wherein said step of diverting said soil laden wash water comprises the steps of providing a coarse screening channel having an inlet from said fine screening channel and having a coarse mesh screen covering a top thereof, otherwise open to the dish compartment;

said step of collecting comprises the steps of providing a fine screen sump open to said fine screen channel and a coarse screen sump open to said coarse screen channel, said fine screen sump and said coarse screen sump having outlets to drain; and opening said outlets to drain soil collected during a drain cycle of said dishwasher.

14. The method according to claim 13, wherein said steps of providing a coarse screening channel and providing a fine screening channel further comprise providing shallow channels as said fine screening channel and said coarse screening channel, each arranged substantially semiannularly to form together a substantially annular channel.

15. The method according to claim 10, comprising the further step of providing a bypass wherein if a back pressure created by fine screening and coarse screening reaches a second predetermined pressure, said soil laden water is bypassed to said dish compartment; and wherein said first predetermined back pressure is less than said second predetermined back pressure.

* * * * *